United States Patent [19]

Hoyme

[11] Patent Number: 4,909,239

[45] Date of Patent: Mar. 20, 1990

[54] FIREPLACE POWER CAP

[76] Inventor: Clifford L. Hoyme, P.O. Box 1485, Camrose, Alberta, Canada, T4V 1X3

[21] Appl. No.: 726,590

[22] Filed: Apr. 23, 1985

[51] Int. Cl.[4] ..... F23L 17/02

[52] U.S. Cl. ..... 126/285 B; 98/59

[58] Field of Search ..... 126/285 B, 286; 98/59, 98/42.18; 49/343

[56] References Cited

U.S. PATENT DOCUMENTS

| | | | |
|---|---|---|---|
| 2,357,642 | 9/1944 | Firehammer | 126/285 B |
| 3,545,365 | 12/1970 | Snader | 98/59 |
| 4,256,257 | 3/1981 | Pinkerton | 98/59 |

FOREIGN PATENT DOCUMENTS

| | | | |
|---|---|---|---|
| 2309800 | 11/1976 | France | 98/59 |
| 531285 | 1/1941 | United Kingdom | 49/343 |

*Primary Examiner*—Henry A. Bennet

*Attorney, Agent, or Firm*—Fleit, Jacobson, Cohn, Price, Holman & Stern

[57] ABSTRACT

A remotely controlled, reversible drive motor is mounted on an extension of the upper end of a chimney below a protective housing enclosing a spiral cam drive mechanism converting rotational movement of the motor into vertical linear motion of a cap laterally spaced from the housing in axial alignment with the chimney extension. Guided movement is thereby imparted to the cap between a closed chimney sealing and open positions.

13 Claims, 3 Drawing Sheets

FIREPLACE POWER CAP

BACKGROUND OF THE INVENTION

This invention relates to an attachment for fireplace chimneys or dwellings and more particularly to a chimney capping arrangement.

The fireplaces in many dwellings are often unused during summer months. During such periods downdrafts of heat, insects and rain enter through the fireplace chimney to create a problem inside the dwelling requiring the sealing of the fireplace or installation of chimney filtering devices, heat and rain traps and the like. Such corrective measures are not only costly, but also introduce various inconveniences and sometimes adversely affect fire control of the chimney over the fireplace.

It is therefore an important object of the present invention to provide an improved solution to the aforementioned problem of downdrafts through the chimney of a fireplace during periods of disuse without the referred to drawbacks.

SUMMARY OF THE INVENTION

In accordance with the present invention, the upper end of a chimney is extended to sealingly receive a cap and prevent undesirable downdrafts and updrafts through the open upper end of the chimney while in disuse. The cap is vertically displaced to adjusted open positions above the chimney during use so as to remain horizontal and continue to act in a weather protective fashion without interfering with normal chimney draft. Such movement of the chimney cap is effected under remote control through a reversible drive motor mounted externally on the chimney extension laterally of the cap and below a weather protected actuator drivingly connecting the motor to the cap. The actuator includes a housing enclosed, spiral cam drive mechanism converting the rotational input of the drive motor into vertically guided linear motion or vertical translation of the chimney cap between its closed and open positions.

These together with other objects and advantages which will subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

Figure 9:
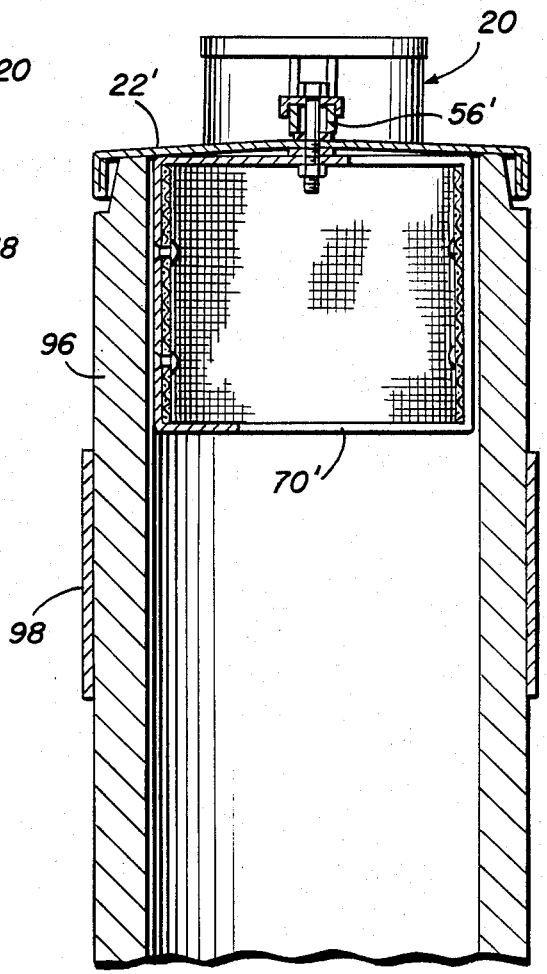
FIG. 9 is an enlarged section view taken substantially through a plane indicated by section line 9—9 in FIG. 8.
Figure 10:
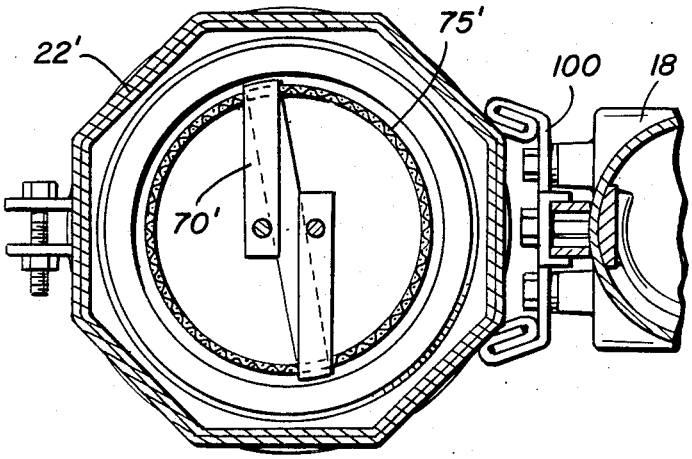
Figure 11:
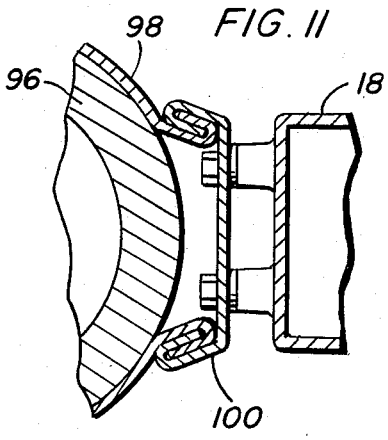

FIGS. 10 and 11 are partial section views taken substantially through planes indicated by section lines 10—10 and 11—11 in FIG. 9.

DETAILED DESCRIPTION OF PREFERRED EMBODIMENT

Figure 1:
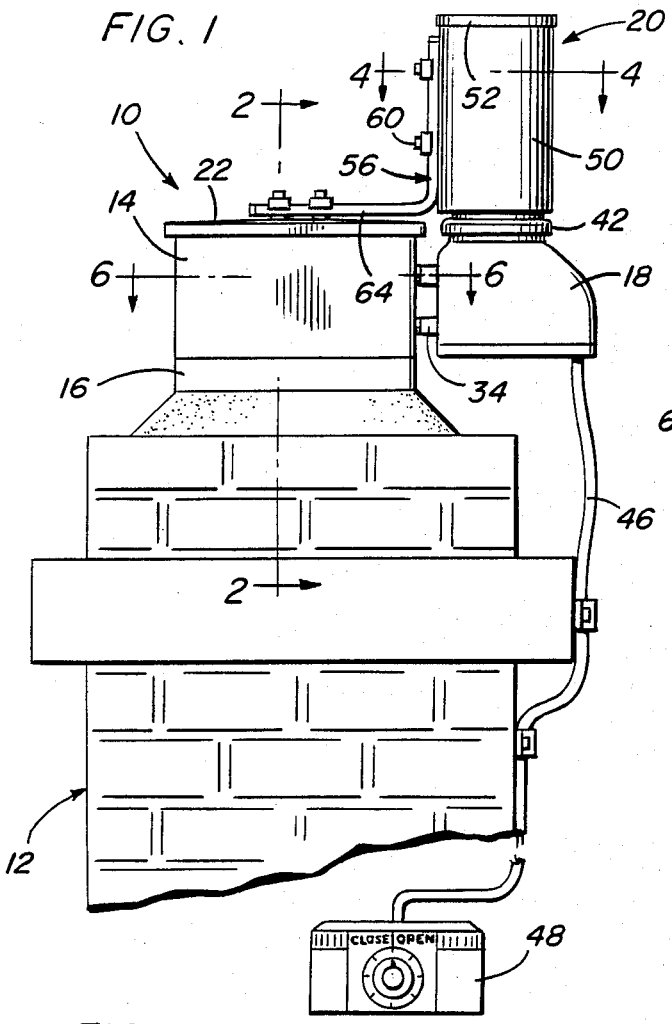
FIG. 1 is a side elevation view showing a typical installation of the present invention in accordance with one embodiment showing a chimney cap in a closed position.
Figure 5:
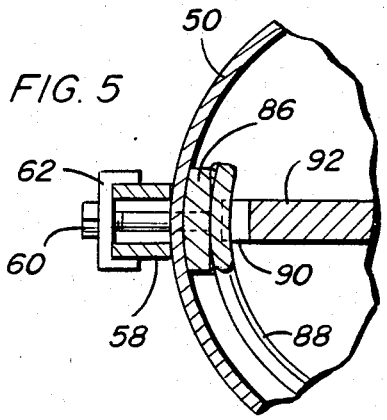
FIG. 5 is an enlarged partial section view taken substantially through a plane indicated by section line 5—5 in FIG. 3.
Figure 6:
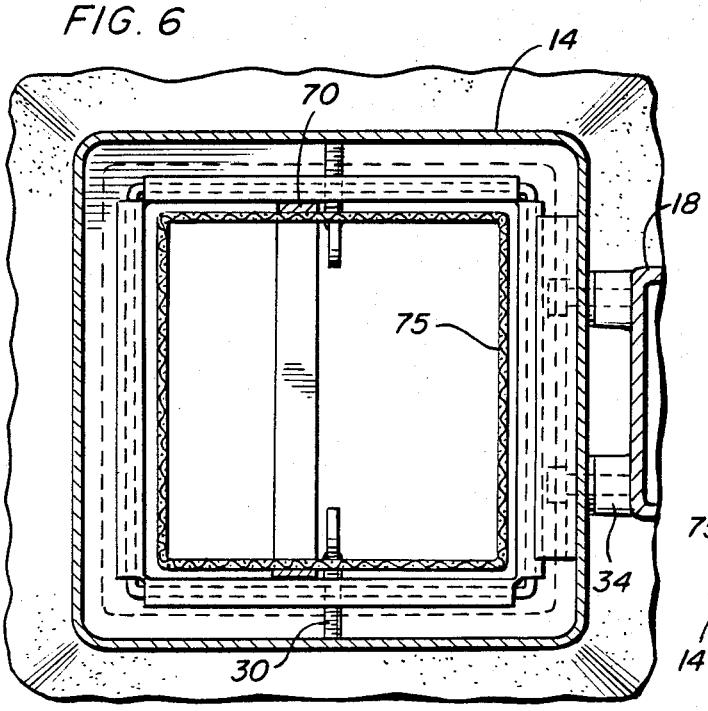
FIG. 6 is a top section view taken substantially through a Plane indicated by section line 6—6 in FIG. 2.
Figure 7:
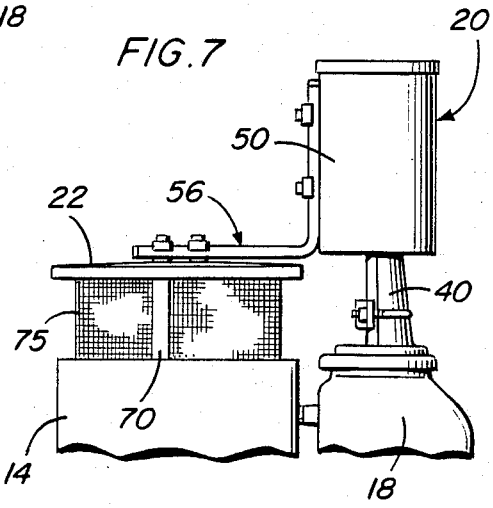
FIG. 7 is a partial side elevation view showing the cap in an open position.

Referring now to the drawings in detail, FIG. 1-7 illustrate a cap assembly generally denoted by reference numeral 10 in accordance with one embodiment of the invention associated with the upper end portion of a chimney stack 12 having a generally rectangular cross-section. The cap assembly includes an outlet extension 14 extending upwardly from the projecting portion of the chimney liner 16, an electrically powered drive motor assembly 18 of well known construction secured externally to the side of the outlet extension 14, an actuator assembly 20 driven by the drive motor 18 and a cap 22 suspended from the actuator assembly in alignment above the open upper end of the chimney extension 14. The cap is adapted to be vertically displaced by the actuator assembly 20 between a lowered chimney sealing position as shown in FIG. 1, and adjusted open positions as shown in FIG. 7.

Figure 2:
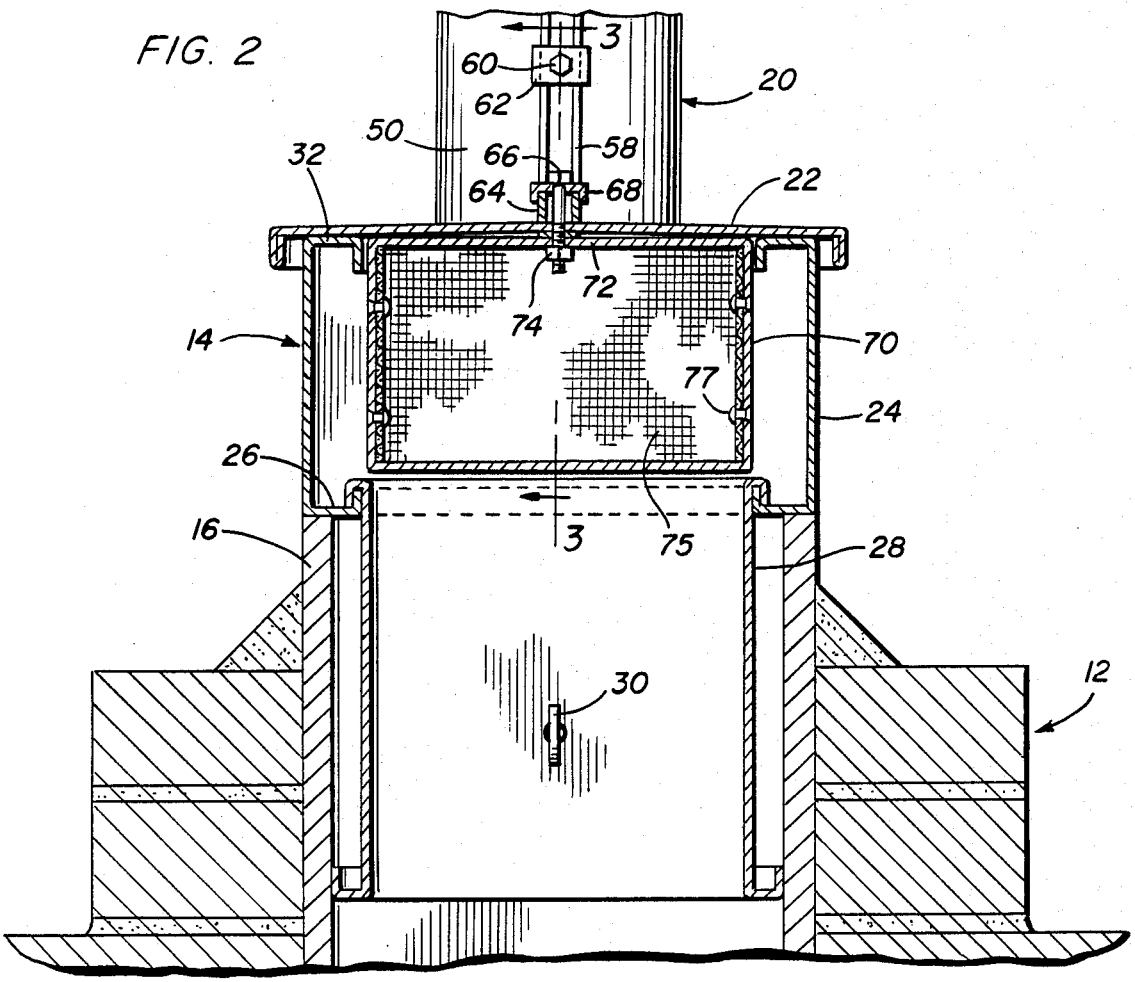
FIG. 2 is an enlarged partial section view taken substantially through a plane indicated by section line 2—2 in FIG. 1.
Figure 3:
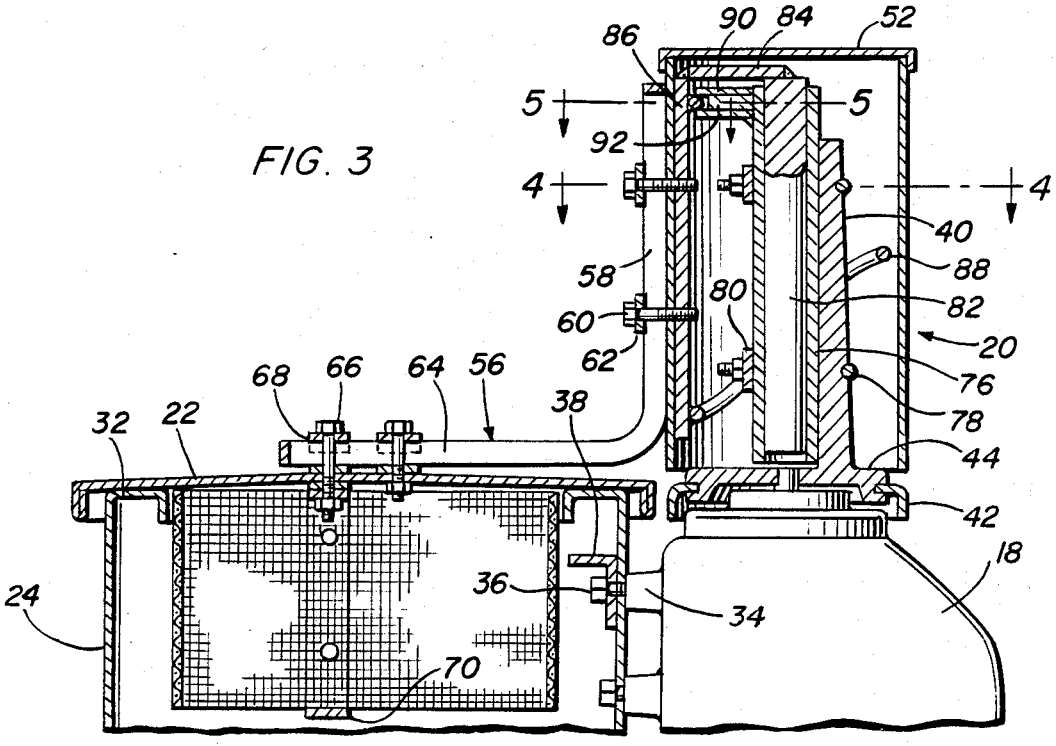
FIG. 3 is a section view taken substantially through a plane indicated by section line 3—3 in FIG. 2.

As more clearly seen in FIG. 2 and 3, the outlet extension is formed sheet metal panels 24 having lower L-shaped flanges 26 abutting the upper rim of the chimney liner 16 and clamped thereto by a sleeve 28 and lock screws 30. Upper flanged portions 32 of the extension panels 24 form a seat for the cover 22 in its closed position as shown.

The housing of the drive motor assembly 18 is bolted through feet 34 to one of the extension panels 24 by threaded fasteners 36. The heads of fasteners 36 bear against a brace bar 38 clamped thereby to the inside of the motor supporting panel as shown in FIGS. 2 and 3. The drive motor assembly as shown in FIG. 3 has a rotor 40 splined or otherwise secured to the output shaft, the rotor 40 projecting into the actuator assembly 20. An annular weather seal 42 is fixed to the lower base portion 44 of the rotor for wiping contact with the upper end portion of the motor housing. An electrical power and control cable 46 as shown in FIG. 1 supplies electrical energy to the motor assembly from a remote location, within the building on which the chimney is mounted, through a reversible motor control console 48 may be of a well known type commonly used for reversible drive of roof mounted directional television antennae.

Figure 4:
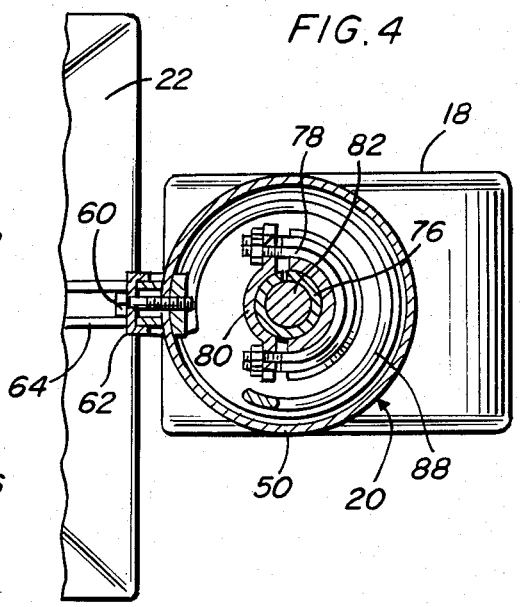
FIG. 4 is a section view taken substantially through a plane indicated by section line 4—4 in FIG. 3.

As more clearly seen in FIGS. 3, 4 and 5, the actuator assembly 20 includes a cylindrical housing 50 having a top closure 52 protectively enclosing therein the rotor 40 and a motion converting drive mechanism generally referred to by reference numeral 54. The rotational movement of rotor 40 is thereby converted into vertical linear motion of the housing 50 to which the cap 22 is connected by a pair of parallel-spaced connecting bars 56. The connecting bars 56 have leg portions 58 secured by fasteners 60 to the housing 50 extending between the bars through spacers 62 into the housing. The leg portions 58 extend downward from the housing 50 into right angle leg portions 64. Leg portions 64 of the bars are similarly secured, by fasteners 66 extending from spacers 68 between the bars into the cap 22. A rectangular loop guide element 70 is clamped to the underside of the cap 22 as shown in FIGS. 2 and 6, by one of the fasteners 66 between a spacing washer 72 and a nut 74. The guide element configuration is such as to prevent rotation of the cap as it is being vertically displaced for translatory movement by the actuator assembly 20. A screen type, spark-arresting case 75 is secured by fasteners 77 to the guide element.

The drive assembly 54 in the embodiment shown in FIGS. 3, 4 and 5 includes a tubular slide bearing sleeve 76 clamped to the rotor in coaxial relation to its rotational axis by a pair of U-shaped clamping rods 78 received in grooves formed in the rotor body and threadably secured to clamp bars 80 abutting the sleeve 76. A shaft 82 is received within slide bearing sleeve 76 with a sliding fit. The upper end of shaft 82 is secured by welding to a radially extending leg 84 of an L-shaped mounting element having a leg portion 86 secured to the inside of the housing 50 by the aforementioned fasteners 60 holding the connecting bars 56 assembled with the housing 50. The mounting element leg portion 86 is secured as by welding to the upper and lower ends of a spiral camming rod 88 encircling the rotor 40 and sleeve 76. The spiral camming rod is engaged between drive bars 90 welded to the upper end of sleeve 76 above and below a spacer 92 to form a cam follower assembly. Accordingly, rotation of the cam follower by rotor 40 through sleeve 76 will impart axial movement o the spiral camming rod 88 and the housing 50 secured thereto through mounting element 86. The housing 50 will be constrained to axial movement by the shaft 82 slidably received within sleeve 76 and prevented from rotation by the guide element 70 to which the housing is connected by the bars 56 as aforementioned.

It will be apparent from the foregoing that powered rotation of the drive motor assembly 18 in opposite directions will impart vertical linear motion to the cap 22 between its closed position, sealing the chimney against downward inflow of air, rain and insects or escape of upwardly flowing warm air, and adjusted open positions allowing escape of smoke.

Figure 8:
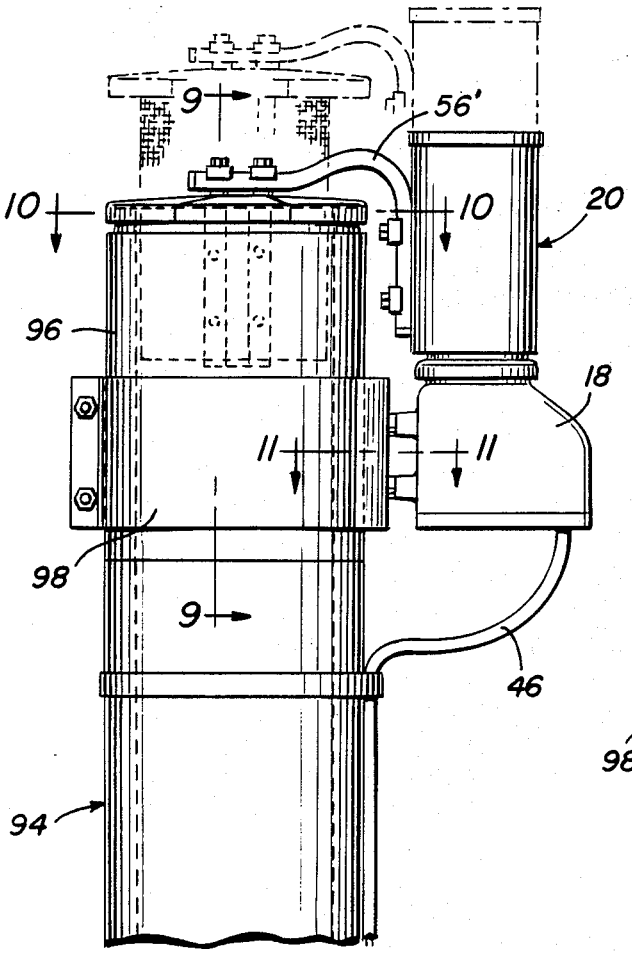
FIG. 8 is a side elevation view of another installation of the invention in accordance with another embodiment.

The chimney capping installation described with respect to FIGS. 1–7 is associated with a cross-sectionally rectangular chimney. For a chimney 94 that is cross-sectionally circular as shown in FIG. 8, a cross-sectionally circular extension 96 is mounted thereon to support a drive motor assembly 18 by means of a clamping band 98 and adjustable band locks 100. The same type of actuator assembly 20 is driven by the drive motor within a space mostly below the upper end of the chimney extension 96. Accordingly, connecting bars 56' extend upwardly from the housing 50 for attachment to a cap 22' that is octagonal in cross-section as shown in FIG. 10. A guide loop 70' depends from cap 22', as shown in FIGS. 9 and 10, into the chimney extension to prevent rotation of the cap. A cylindrical screen cage 75' is also secured to the guide element 70' for spark arresting purposes. Closing and opening of the cap is effected in the same manner as described with respect to FIGS. 1–7. Thus, through the control knob on the motor control console 48, the cap may be displaced between open and closed positions for chimney sealing purposes or for full fire control.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a chimney having an exposed upper end portion from which exhaust products escape, a device for selectively closing the upper end portion of the chimney, comprising a chimney sealing cap, a drive motor disposed externally on the chimney, actuator means operatively connected to the drive motor for movement relative to the chimney, connecting means securely attached to the actuator means and operatively connecting the actuator means to the cap for causing both raising and lowering of the cap by vertical translation thereof, and means mounting the drive motor on the upper end portion of the chimney, said connecting means being both raised and lowered with the cap by said vertical translation in alignment with the chimney upper end portion between lowered closing and opened horizontal positions thereabove.

2. In combination with a fireplace chimney having an exposed end portion from which exhaust products escape, a device for selectively closing the upper end portion of the chimney, comprising a chimney sealing cap, a drive motor mounted externally on said upper end portion of the chimney, actuator means operatively connected to the drive motor for movement relative to the upper end portion, and means operatively connecting the actuator means to the cap for vertical displacement thereof in alignment with the upper end portion between a lowered closing position and opened positions thereabove, said actuator means including a rotor connected to the drive motor, a tubular housing on which the connecting means is mounted, bearing means slidably mounting the tubular housing in coaxial enclosing relation on the rotor, and spiral drive means drivingly connecting the rotor to the tubular housing for converting rotational movement of the rotor into axial displacement of the cap.

3. The combination of claim 2 wherein the connecting means includes a connecting bar secured to the tubular housing and extending laterally therefrom above the cap, guide means depending from the cap into the upper end portion of the chimney for preventing angular displacement of the cap and the tubular housing relative to the chimney, and fastener means for fixedly interconnecting the connecting bar, the cap and the guide means.

4. The combination of claim 3 wherein the bearing means includes an elongated sleeve clamped to the rotor and a shaft slidably received in the sleeve and connected to the tubular housing in radially spaced relation to the sleeve.

5. The combination of claim 4 wherein the spiral drive means includes a spiral cam fixed internally to the tubular housing and follower means fixed to the sleeve and engaged with the spiral cam for axial displacement of the shaft and the tubular housing relative to the sleeve in response to rotation of the rotor by the drive motor.

6. The combination of claim 2 wherein the bearing means includes an elongated sleeve clamped to the rotor and a shaft slidably received in the sleeve and connected to the tubular housing in radially spaced relation to the sleeve.

7. The combination of claim 6 wherein the spiral drive means includes a spiral cam fixed internally to the tubular housing and follower means fixed to the sleeve and engaged with the spiral cam for axial displacement of the shaft and the tubular housing relative to the sleeve in response to rotation of the rotor by the drive motor.

8. In combination with a chimney having an exposed upper end portion from which exhaust products escape, a device for selectively closing the upper end portion of the chimney, comprising a chimney sealing cap, a drive motor and means drivingly connecting the drive motor to the cap for vertical translation of the cap from a lowered horizontal closing position in response to rotation of the drive motor, the improvement comprising means mounting the drive motor on the upper end portion externally of the chimney and a tubular housing member connected to the cap in protective enclosing relation to the vertical translation means laterally offset from the upper end portion of the chimney.

9. The combination of claim 8 including a rotor driven by the drive motor within the tubular housing member and a slide bearing member secured to the rotor, said camming means including a spiral cam element fixed to one of said members and a follower element engaged with the cam element and fixed to the other of the members.

10. The combination of claim 8 including translation guide means depending from the cap into the upper end portion of the chimney for maintaining the cap in axial alignment with the chimney.

11. The combination of claim 9 including a screen cage carried by guide means.

12. In combination with a fireplace chimney having an exposed upper end portion from which exhaust products escape, a device for selectively closing the upper end portion of the chimney, comprising a chimney sealing cap, a drive motor mounted on said upper end portion of the chimney, camming means drivingly connecting the drive motor to the cap for vertical displacement of the cap from a lowered closing position in response to rotation of the drive motor, a tubular housing member connected to the cap in protective enclosing relation to the camming means laterally offset from the upper end portion of the chimney and, guide means depending from the cap into the upper end portion of the chimney for preventing rotation of the cap relative to the chimney.

13. The combination of claim 12 including a screen cage carried by guide means.

* * * * *